US008965604B2

(12) United States Patent
Nandedkar et al.

(10) Patent No.: US 8,965,604 B2
(45) **Date of Patent: *Feb. 24, 2015**

(54) SYSTEM AND METHOD FOR DETERMINING A QUALITY VALUE OF A LOCATION ESTIMATION OF A POWERED SYSTEM

(75) Inventors: Vishram Vinayak Nandedkar, Bangalore (IN); Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 140 days.

This patent is subject to a terminal disclaimer.

(21) Appl. No.: 13/480,814

(22) Filed: May 25, 2012

(65) Prior Publication Data

US 2012/0232726 A1 Sep. 13, 2012

Related U.S. Application Data

(63) Continuation-in-part of application No. 12/047,496, filed on Mar. 13, 2008, now Pat. No. 8,190,312.

(51) Int. Cl.
*B61L 25/02* (2006.01)

(52) U.S. Cl.
CPC ..... *B61L 25/021* (2013.01); *B61L 25/025* (2013.01); *B61L 25/026* (2013.01)
USPC ..... 701/19

(58) Field of Classification Search
CPC ... B61L 25/025; B61L 25/021; B61L 25/026; B61L 2205/04
USPC ..... 701/19, 20, 200, 207, 213, 214, 216, 701/217, 220; 342/357.3, 357.32
See application file for complete search history.

(56) References Cited

U.S. PATENT DOCUMENTS

| | | | |
|---|---|---|---|
| 3,519,805 | A | 7/1970 | Thorne-Booth |
| 3,650,216 | A | 3/1972 | Harwick |
| 3,655,962 | A | 4/1972 | Koch |

(Continued)

FOREIGN PATENT DOCUMENTS

| | | |
|---|---|---|
| EP | 1297982 | 4/2003 |
| JP | 2000247235 A | 9/2000 |

(Continued)

OTHER PUBLICATIONS

Unofficial English translation of Office Action issued in connection with corresponding KZ Application No. 2009/1529.1.

*Primary Examiner* — Zachary Kuhfuss
(74) *Attorney, Agent, or Firm* — GE Global Patent Operation; John A. Kramer

(57) ABSTRACT

A system is provided for determining a quality of a location estimation of a powered system at a location. The system includes a first sensor configured to measure a first parameter of the powered system at the location. The system further includes a second sensor configured to measure a second parameter of the powered system at the location. The system further includes a second controller configured to determine the location estimation of the powered system and the quality of the location estimation, based upon a first location of the powered system based on the first parameter, and a second location of the powered system based on the second parameter of the powered system. A method is also provided for determining a quality of a location estimation of a powered system at a location.

32 Claims, 6 Drawing Sheets

(56) References Cited

U.S. PATENT DOCUMENTS

| | | | |
|---|---|---|---|
| 3,865,042 | A | 2/1975 | Depaola |
| 4,005,838 | A | 2/1977 | Grundy |
| 4,041,283 | A | 8/1977 | Mosier |
| 4,042,810 | A | 8/1977 | Mosher |
| 4,181,943 | A | 1/1980 | Mercer, Sr. |
| 4,253,399 | A | 3/1981 | Spigarelli |
| 4,279,395 | A | 7/1981 | Boggio |
| 4,344,364 | A | 8/1982 | Nickles et al. |
| 4,401,035 | A | 8/1983 | Spigarelli |
| 4,561,057 | A | 12/1985 | Haley, Jr. |
| 4,602,335 | A | 7/1986 | Perlmutter |
| 4,711,418 | A | 12/1987 | Aver, Jr. |
| 4,735,385 | A | 4/1988 | Nickles |
| 4,794,548 | A | 12/1988 | Lynch |
| 4,827,438 | A | 5/1989 | Nickles |
| 4,853,883 | A | 8/1989 | Nickles |
| 5,109,343 | A | 4/1992 | Budway |
| 5,398,894 | A | 3/1995 | Pascoe |
| 5,437,422 | A | 8/1995 | Newman |
| 5,440,489 | A | 8/1995 | Newman |
| 5,676,059 | A | 10/1997 | Alt |
| 5,744,707 | A | 4/1998 | Kull |
| 5,758,299 | A | 5/1998 | Sandborg |
| 5,785,392 | A | 7/1998 | Hart |
| 5,828,979 | A | 10/1998 | Polivka |
| 5,950,967 | A | 9/1999 | Montgomery |
| 6,112,142 | A | 8/2000 | Shockley |
| 6,125,311 | A | 9/2000 | Lo |
| 6,144,901 | A | 11/2000 | Nickles |
| 6,226,591 | B1 | 5/2001 | Okumura |
| 6,268,804 | B1 | 7/2001 | Janky |
| 6,269,034 | B1 | 7/2001 | Shibuya |
| 6,308,117 | B1 | 10/2001 | Ryland |
| 6,456,937 | B1 | 9/2002 | Doner |
| 6,487,488 | B1 | 11/2002 | Peterson, Jr. |
| 6,490,523 | B2 | 12/2002 | Doner |
| 6,505,103 | B1 | 1/2003 | Howell |
| 6,516,727 | B2 | 2/2003 | Kraft |
| 6,591,758 | B2 | 7/2003 | Kumar |
| 6,609,049 | B1 | 8/2003 | Kane et al. |
| 6,612,245 | B2 | 9/2003 | Kumar |
| 6,612,246 | B2 | 9/2003 | Kumar |
| 6,615,118 | B2 | 9/2003 | Kumar |
| 6,641,090 | B2 | 11/2003 | Meyer |
| 6,691,957 | B2 | 2/2004 | Hess, Jr. |
| 6,694,231 | B1 | 2/2004 | Rezk |
| 6,732,023 | B2 | 5/2004 | Sugita |
| 6,763,291 | B1 | 7/2004 | Houpt |
| 6,789,005 | B2 | 9/2004 | Hawthorne |
| 6,810,312 | B2 | 10/2004 | Jammu |
| 6,824,110 | B2 | 11/2004 | Kane |
| 6,845,953 | B2 | 1/2005 | Kane |
| 6,853,888 | B2 | 2/2005 | Kane |
| 6,856,865 | B2 | 2/2005 | Hawthorne |
| 6,863,246 | B2 | 3/2005 | Kane |
| 6,865,454 | B2 | 3/2005 | Kane |
| 6,903,658 | B2 | 6/2005 | Kane |
| 6,915,191 | B2 | 7/2005 | Kane |
| 6,922,619 | B2 | 7/2005 | Baig |
| 6,957,131 | B2 | 10/2005 | Kane |
| 6,978,195 | B2 | 12/2005 | Kane |
| 6,980,894 | B1 | 12/2005 | Gordon |
| 6,996,461 | B2 | 2/2006 | Kane |
| 7,021,588 | B2 | 4/2006 | Hess, Jr. |
| 7,021,589 | B2 | 4/2006 | Hess, Jr. |
| 7,024,289 | B2 | 4/2006 | Kane |
| 7,036,774 | B2 | 5/2006 | Kane |
| 7,079,926 | B2 | 7/2006 | Kane |
| 7,092,800 | B2 | 8/2006 | Kane |
| 7,092,801 | B2 | 8/2006 | Kane |
| 7,096,096 | B2 | 8/2006 | Kane |
| 7,209,810 | B2 | 4/2007 | Meyer |
| 7,869,950 | B2 | 1/2011 | Ueda |
| 2002/0059075 | A1 | 5/2002 | Schick |
| 2002/0096081 | A1 | 7/2002 | Kraft |
| 2003/0213875 | A1 | 11/2003 | Hess, Jr. |
| 2004/0133315 | A1 | 7/2004 | Kumar |
| 2004/0245410 | A1 | 12/2004 | Kisak |
| 2005/0065674 | A1 | 3/2005 | Houpt |
| 2005/0065726 | A1* | 3/2005 | Meyer et al. ..... 701/213 |
| 2005/0120904 | A1 | 6/2005 | Kumar |
| 2006/0025921 | A1 | 2/2006 | Jung |
| 2007/0219680 | A1 | 9/2007 | Kumer |
| 2009/0138199 | A1 | 5/2009 | Bonanni |

FOREIGN PATENT DOCUMENTS

| | | | |
|---|---|---|---|
| RU | 2004104789 | A | 7/2005 |
| RU | 2272731 | C2 | 3/2006 |
| WO | 89/05255 | A1 | 6/1989 |

* cited by examiner

SYSTEM AND METHOD FOR DETERMINING A QUALITY VALUE OF A LOCATION ESTIMATION OF A POWERED SYSTEM

CROSS-REFERENCE TO RELATED APPLICATIONS

This application is a continuation-in-part of U.S. patent application Ser. No. 12/047,496, which was filed on 13 Mar. 2008 now U.S. Pat. No. 8,190,312. The entire subject matter of U.S. patent application Ser. No. 12/047,496 is incorporated by reference.

BACKGROUND

Rail vehicles, such as a train having one or more locomotives, for example, travel along a route from one location to another. Some trains travel along the route in an automatic mode in which, prior to traveling along the route, a controller predetermines one or more train parameters, such as speed and notch setting, for example, at each location along the route. In order to predetermine the train parameter(s) at each location along the route, the controller may use a memory which prestores a characteristic of the route at each location, such as the grade, for example. While traveling along the route, the controller may need to be aware of the train location to ensure that actual train parameter(s) track or match the predetermined train parameter(s) at each train location. Additionally, since the route may include various train parameter restrictions at various locations, such as a speed restriction, for example, the controller may need to be aware when the train location is approaching a location of a restriction in order to adjust the train parameter(s), if needed, to comply with the train parameter restriction.

Alternatively, the train may travel along the route in a manual mode, in which the train operator is responsible for manually adjusting the train parameters. As with the automatic mode, while traveling along the route, the train operator may need to be aware of the train location, such as when the train location approaches a restriction location, for example. The train operator can then manually adjust the train parameter(s) to comply with a train parameter restriction.

Some known systems have been designed to assist the controllers in the automatic mode and the train operators in the manual mode by providing locations of the train as the train travels along the route. These systems, however, may rely solely on a global positioning satellite (GPS) system, which provides one measurement of the train location based on satellite positioning, or other positioning systems using wireless network or wayside equipment, to provide raw position measurements of the train. Upon receiving the positioning system measurement, the controller uses an internal memory to convert this raw position measurement to a distance measurement of the train along the route.

As with any measurement system, such position measurement systems are capable of error, such as if a GPS receiver of the train fails to communicate with a sufficient number of satellites in the GPS system or an error in the memory of the controller which may convert an accurate raw position measurement to an inaccurate distance measurement along the route, for example. Accordingly, it would be advantageous to provide plural independent distance measurements, such as an independent distance or position measurement in addition to a GPS measurement of the distance of the train along the route, so to ensure that the distance estimation provided to the controller or train operator is reliable. Additionally, it would be advantageous to assign a quality value to the distance estimation provided to the controller or train operator.

BRIEF DESCRIPTION

In one embodiment of the presently described inventive subject matter, a system is provided for determining a quality value of a location estimation of a powered system at a location. The system includes a first sensor configured to measure a first parameter of the powered system at the location. The system further includes a second sensor configured to measure a second parameter of the powered system at the location. The system further includes a second controller configured to determine the location estimation of the powered system and the quality value of the location estimation, based upon a first location of the powered system based on the first parameter, and a second location of the powered system based on the second parameter of the powered system.

In one embodiment of the presently described inventive subject matter, a system is provided for determining a quality value of a location estimation of a powered system at a location. The system includes a speed sensor configured to determine a speed of the powered system at the location. The system further includes a position determination device configured to provide a measured position of the powered system. The system further includes a second controller configured to determine the quality value of the location estimation during a first time period when the position determination device provides the measured position of the powered system. The quality value is based on at least one of an uncertainty in the position of the powered system and an uncertainty in the speed of the powered system.

In one embodiment of the presently described inventive subject matter, a method is provided for determining a quality value of a location estimation of a powered system at a location. The method includes measuring a speed of the powered system at the location, and measuring a position of the powered system. The method further includes determining the location estimation of the powered system and the quality value of the location estimation. The step of determining the location estimation and quality value of the location estimation is based upon a first location of the powered system based on the speed, and a second location of the powered system based on the measured position of the powered system.

In one embodiment, a system (e.g., a control system) includes a speed sensor, a position determination device, and at least one controller. The speed sensor is configured to output speed data representative of a measured speed at which a powered system is traveling at a location. With respect to rail vehicles as the powered system, the powered system may be traveling along a predefined trajectory, such as along a track. The position determination device is configured to output location data representative of a measured position of the powered system at the location. The at least one controller is configured to determine a location estimation of the powered system based on a speed-based distance estimation and a position-based distance estimation of the powered system from one or more reference points. The speed-based distance estimation is based at least in part on the measured speed and the position-based distance estimation is based at least in part on the measured position. The at least one controller is configured to determine a quality value of the location estimation that is based at least in part on the location estimation and the measured position of the powered system. The powered system is a rail vehicle consist comprising at least one locomotive having the speed sensor, the position determination device, and the at least one controller.

In another embodiment, a method (e.g., for controlling a powered system) includes receiving speed data from a speed sensor disposed onboard a locomotive of a rail vehicle consist. The speed data is representative of a measured speed at which the rail vehicle consist is traveling at a location. The method also includes receiving location data from a position determination device disposed onboard the locomotive of the rail vehicle consist. The location data is representative of a measured position of the rail vehicle consist at the location. The method further includes determining a speed-based distance estimation of the rail vehicle consist based at least in part on the speed data. The speed-based distance estimation is representative of separation of the rail vehicle consist from a reference point. The method includes determining a position-based distance estimation of the rail vehicle consist based at least in part on the location data. The position-based distance estimation representative of the separation of the rail vehicle consist from the reference point. The method further includes determining a location estimation of the rail vehicle consist from the speed-based distance estimation and the position-based distance estimation and determining a quality value of the location estimation based at least in part on the location estimation and the measured position of the rail vehicle consist.

In another embodiment, a system (e.g., a vehicle control system) includes a speed sensor, a position determination device, and one or more controllers. The speed sensor is configured to generate speed data that represents a velocity of a vehicle system along a route. The position determination device is configured to generate location data that represents a position of the vehicle system along the route. The one or more controllers are configured to determine a speed-based distance of the vehicle system from a reference location based on the speed data and to determine a location-based distance of the vehicle system from the reference location based on the location data. The one or more controllers also are configured to determine a location estimation of the vehicle system along the route based on the speed-based distance and the location-based distance and to determine a quality value of the location estimation based on the location data. The one or more controllers also are configured to at least one of autonomously control or direct manual control of the velocity of the vehicle system according to a trip plan that designates speeds of the vehicle system as a function of distance along the route. The one or more controllers also are configured to use the location estimation to determine the velocity of the vehicle system according to the trip plan responsive to the quality value remaining within a designated range.

BRIEF DESCRIPTION OF THE DRAWINGS

A more particular description of the embodiments of the inventive subject matter described herein will be rendered by reference to specific embodiments thereof that are illustrated in the appended drawings. Understanding that these drawings depict only some embodiments of the inventive subject matter and are not therefore to be considered to be limiting of the entire scope of the inventive subject matter, the embodiments of the inventive subject matter will be described and explained with additional specificity and detail through the use of the accompanying drawings in which.

DETAILED DESCRIPTION

Figure 1:
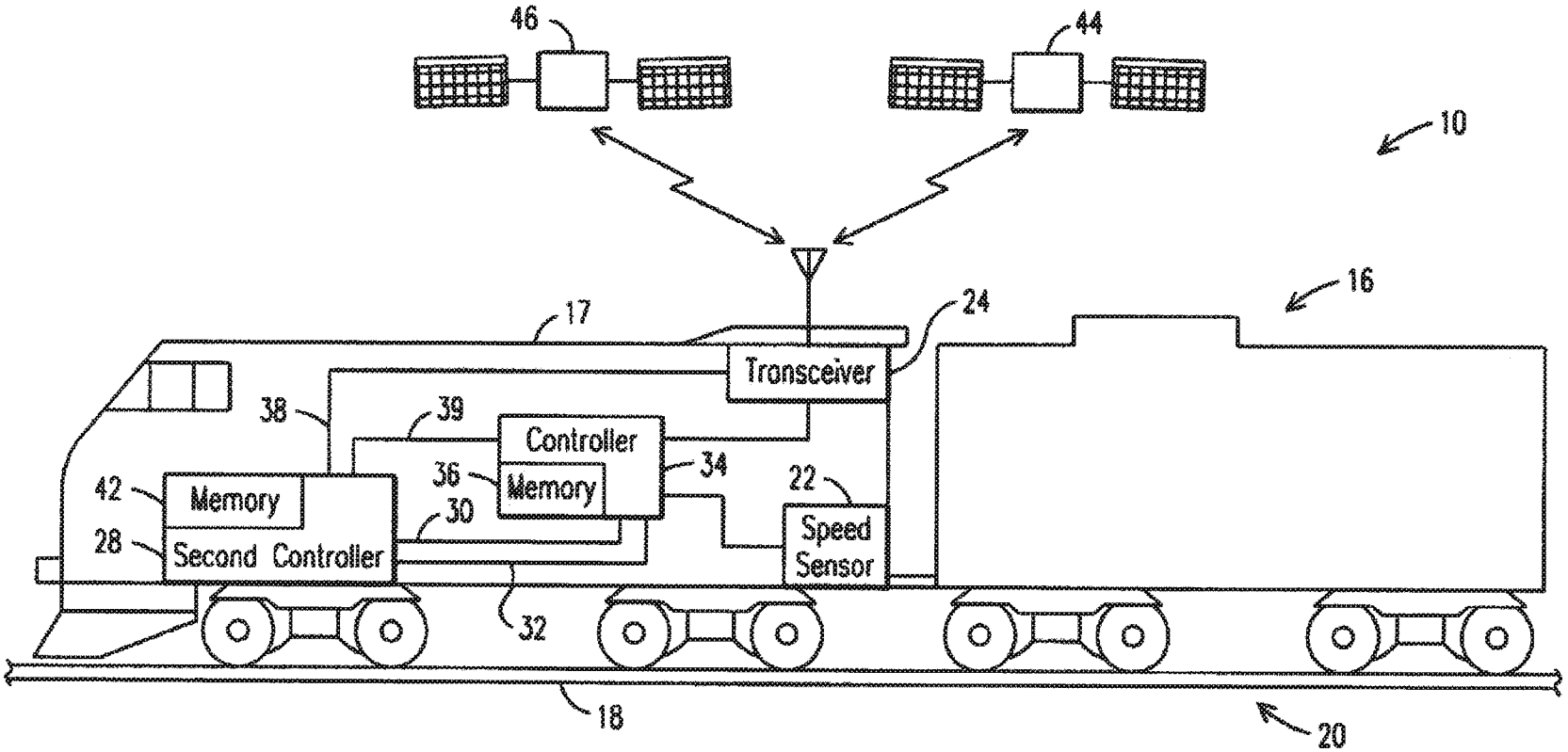
FIG. 1 is a side plan view of one example embodiment of a system for determining a quality value of a distance estimation of a powered system at a location along a route.

In describing particular features of different embodiments of the presently described inventive subject matter, number references will be utilized in relation to the figures accompanying the specification. Similar or identical number references in different figures may be utilized to indicate similar or identical components among different embodiments of the inventive subject matter.

Though example embodiments of the presently described inventive subject matter are described with respect to rail vehicles, or railway transportation systems, specifically trains and locomotives having diesel engines, example embodiments of the inventive subject matter also are applicable for other uses, such as but not limited to off-highway vehicles (OHV), marine vessels, automobiles, agricultural vehicles, transport buses, and the like, one or more of which may use at least one engine (e.g., diesel engine), such as an internal combustion engine. Toward this end, when discussing a specified mission, the mission may include a task or requirement to be performed by the powered system. With respect to railway vehicles, marine vehicles, transport vehicles, agricultural vehicles, OHVs, automobiles, and the like as a powered system, the term "mission" may refer to the movement of the vehicle from a present location to a destination. Operating conditions of power generating units in a powered system may include one or more of speed, load, fueling value, timing, and the like. Furthermore, although diesel powered systems are disclosed, one or more embodiments disclosed herein also may be utilized with non-diesel powered systems, such as but not limited to natural gas powered systems, bio-diesel powered systems, electric powered systems, and the like. Furthermore, as disclosed herein, the powered systems may include multiple engines, other power sources, and/or additional power sources, such as, but not limited to, battery sources, voltage sources (such as but not limited to capacitors), chemical sources, pressure-based sources (such as but not limited to spring and/or hydraulic expansion), current sources (such as but not limited to inductors), inertial sources (such as but not limited to flywheel devices), gravitational-based power sources, thermal-based power sources, and the like.

In one example involving marine vessels, a plurality of tug boats or vessels (e.g., also referred to as powered units) may be operating together where several or all of the tug boats are moving the same larger marine vessel, the tug boats may be linked in time to accomplish the mission of moving the larger vessel. In another example, a single marine vessel may have a plurality of engines. OHVs may involve a fleet of vehicles that have a common mission to move earth or other materials, from a first location to a different, second location, where each OHV is linked in time to accomplish the mission. In one example involving rail vehicles, a plurality of powered systems (e.g., locomotives or other rail vehicles capable of self-propulsion) may be operating together where all are moving the same larger load and are linked in time to accomplish a mission of moving the larger load. In another example embodiment, a rail vehicle may have more than one powered system.

Figure 2:
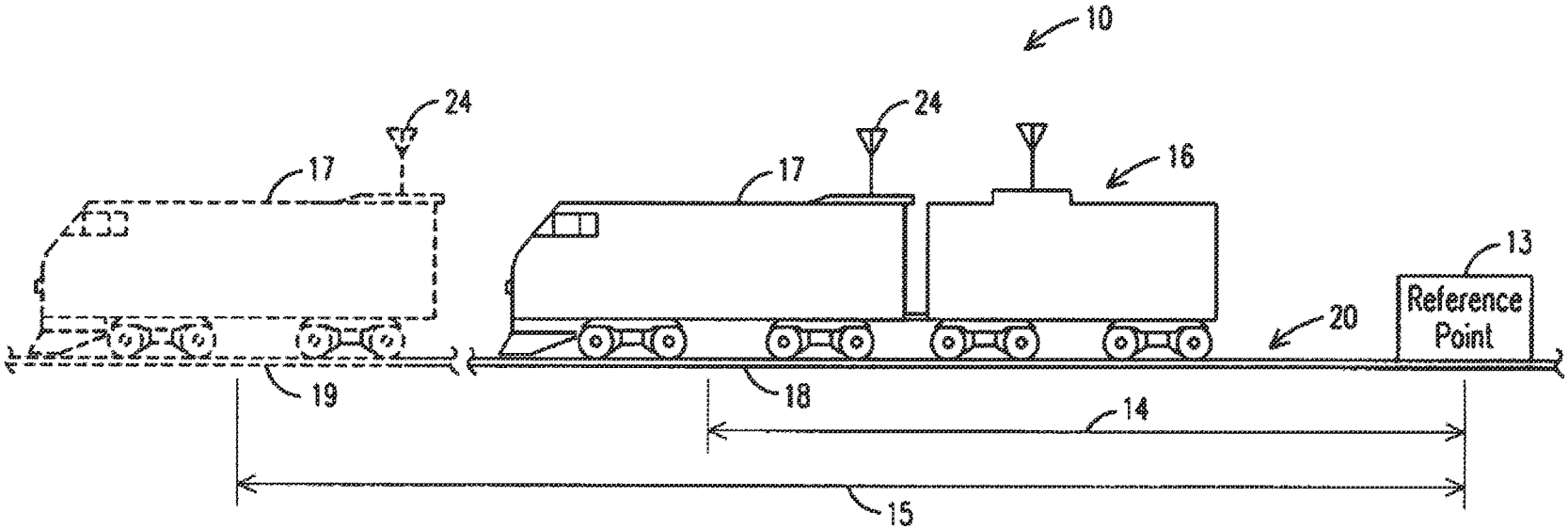
FIG. 2 is a side plan view of one example embodiment of a system for determining a quality value of a distance estimation of a powered system at a plurality of locations along a route.
Figure 3:
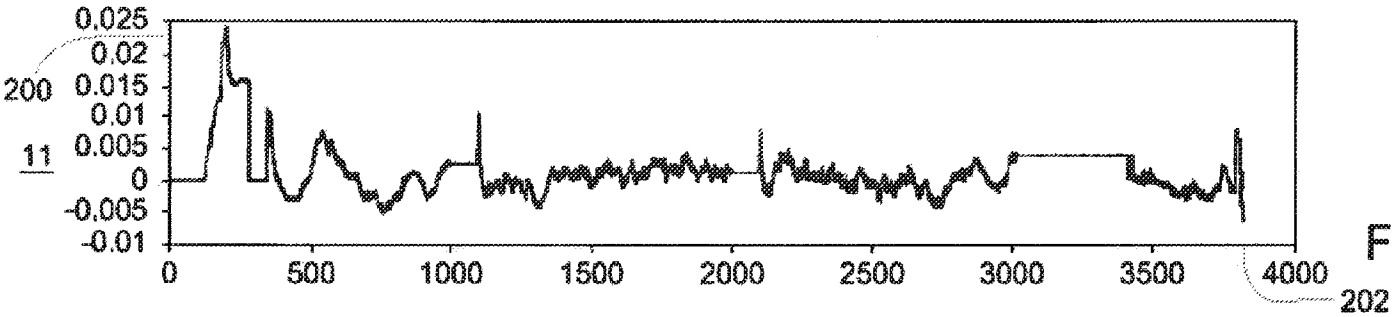
FIG. 3 is a plot of one example embodiment of a first quality value of a distance estimation of the powered system at a plurality of locations along a route.
Figure 4:
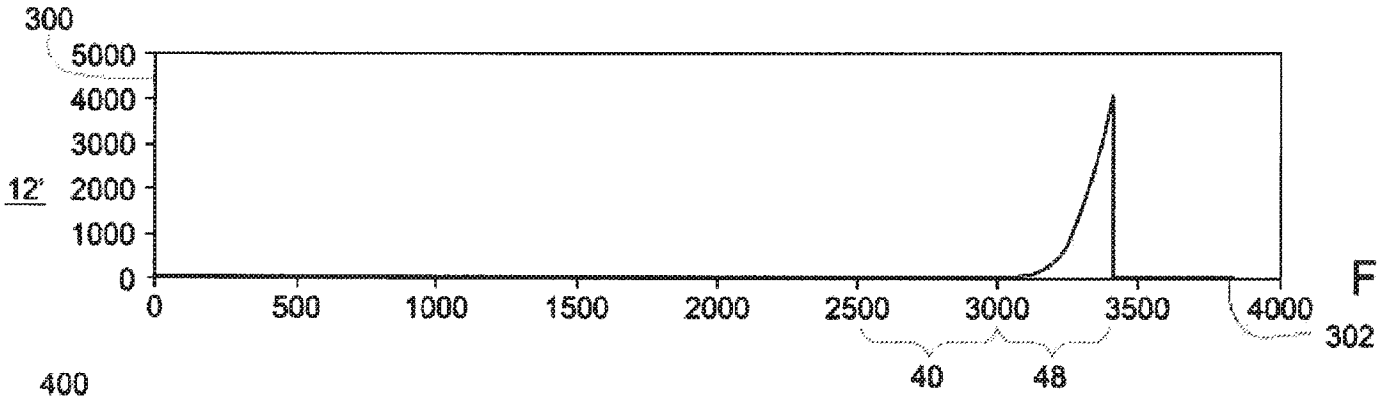
FIG. 4 is a plot of one example embodiment of a second quality value of a distance estimation of the powered system at a plurality of locations along a route.

FIGS. 1 and 2 illustrate an example embodiment of an evaluation system 10 for determining a quality value 12 (e.g., as shown in FIGS. 3 and 4) of a distance estimation 14 of a powered system, such as a rail vehicle consist 16 having one or more powered units 17 (e.g., locomotives) at a location 18 along a route 20. The distance estimation 14 is based on a reference point 13 along the route 20, such as a destination location of a trip, a city boundary, a milestone, a wayside device, or any similar reference point. Although the reference point 13 in FIG. 1 is a previous location along the route 20, the reference point 13 may be a future or upcoming location along the route 20, for example. Although the illustrated embodiments of FIGS. 1 through 7 illustrate a system for determining a quality value of a distance estimation of a rail vehicle, such as a rail vehicle consist, along a route, the embodiments of the inventive subject matter may be employed for another powered system, such as OHVs, marine vehicles, in addition to other applications, for example, which do not travel along a track. One or more embodiments of the presently described inventive subject matter may be employed to determine a location estimation and a respective quality value of the location estimation for these powered systems, as the powered systems may not follow a prescribed distance along a predetermined route, as with a rail vehicle, for example. The location estimation may be based on (e.g., be a combination of) a speed-based distance estimation and a position-based distance estimation of the powered system at a location from a reference position. The quality value can represent an accuracy of the location estimation and may be used to determine a reliability of the location estimation.

The evaluation system 10 includes a speed sensor 22 positioned on the powered unit 17 to measure a speed of the powered system 16 at the location 18 along the route 20. The speed sensor 22 may be any type of speed sensors used to measure the speed of a moving powered unit, such as a wheel speed sensor. The evaluation system 10 further includes a controller 34 coupled to the speed sensor 22. The speed sensor 22 measures one or more characteristics of movement of the powered unit 17 (e.g., revolutions per minute of one or more wheels, axles, engines, and the like, velocity of the powered unit 17, and the like) and generates speed data representative of the movement of the powered unit 17. The speed data may be or include a measurement of the actual speed of the powered unit 17 or may include information that is used by the controller 34 to calculate or determine the velocity of the powered unit 17. The controller 34 determines a first distance estimation 30 of the powered system 16 from the reference point 13 along the route 20 based on the speed of the train 16 from the reference point 13 to the location 18 along the route 20. The first distance estimation 30 may be referred to as a speed-based distance estimation. In one embodiment, the controller 34 integrates the speed of the train 16 over the time period that the train 16 travels between the reference point 13 and the location 18 to determine the first distance estimation 30. Although the speed sensor 22 illustrated in FIG. 1 is configured to send speed data to the controller 34, and the controller 34 calculates the first distance estimation 30, speed sensors that internally calculate the first distance estimation 30 and transmit the first distance estimation 30 to a second controller, as discussed below. In one embodiment, in addition to the speed data, the speed sensor 22 can output an uncertainty signal 39 to the controller 34, which is subsequently transmitted to a second controller (see below) for determining a third quality value 12 of the distance estimation 14. The uncertainty signal 39 is indicative of a level of uncertainty in the measured speed of the powered system 16. The level of uncertainty may be a tunable (e.g., adjustable) constant. The uncertainty signal 39 may come directly from the speed sensor 22 to the second controller 28, for example.

The evaluation system 10 further includes a position determination device 24, such as a transceiver or receiver, and associated communication circuitry, for example, to acquire location data representative of a measured position of the powered system 16. In one embodiment, the position determination device 24 is a GPS device configured to communicate with a plurality of global positioning satellites 44, 46, for example. Although FIG. 1 illustrates a pair of global positioning satellites 44, 46, the position determination device 24 may be configured to communicate with more than two global positioning satellites, for example. The position determination device 24 may determine the actual position (e.g., location) of the powered system 16 or powered unit 17 as the location data. Alternatively, the position determination device 24 may generate the location data as being representative of the location data, such as the information received from the satellites 44, 46. For example, the position determination device 24 may receive message signals from the satellites 44, 46 that include positions of the satellites and the times at which the message signals are transmitted from the satellites 44, 46. The position determination device 24 can determine distances from the satellites 44, 46 to the position determination device 24 from this information and determine the position of the powered system 16 or powered unit 17 based on these distances. The position determination device 24 may then communicate the position of the powered system 16 or powered unit 17 as the location data to the controller 34. Alternatively, the position determination device 24 can communicate the message signals received from the satellites 44, 46 as the location data, the distances from the satellites 44, 46 to the position determination device 24 as the location data, the positions of the satellites 44, 46, and/or the times at which the satellites 44, 46 transmit the message signals as the location data to the controller 34. The controller 34 may then determine the position of the powered system 16 or powered unit 17 from the location data.

In another embodiment, the position determination device 24 may receive the speed data from the speed sensor 22 and determine the speed-based distance estimation 30. For example, the position determination device 24 may integrate the speed data over time to determine the distance estimation 30.

The controller 34, speed sensor 22, and position determination device 24 may all be disposed onboard a single powered unit 17 of a powered system 16 that includes one or more powered units 17. Alternatively, one or more of the controller 34, the speed sensor 22, and/or the position determination device 24 may be located onboard another powered unit 17 or a non-powered unit (e.g., a vehicle incapable of self-propulsion but that may otherwise consume electric current to power one or more loads) of the same powered system 16.

In one embodiment, in contrast with the first distance estimation 30 of the powered system 16 from the reference point 13 to the location 18 along the route 20, the measured position of the powered system 16 or powered unit 17 may be a raw position of the powered system 16 or powered unit 17 (e.g., a latitude/longitude of the powered system 16 or powered unit 17, for example), and may not correlate or represent a distance of the powered system 16 or powered unit 17 from the reference point 13 along the route 20. Although FIG. 1 illustrates one position determination device 24 (e.g., a single transceiver), more than one position determination device 24 may be provided, such as two or more GPS sensors, wayside equipment, manual input from an operator (upon recognizing a milepost, for example), and any combination thereof. Additionally, although the powered system 16 illustrated in FIG. 1 includes one powered unit 17, more than one powered unit 17 may be included in a powered system 16, and each powered unit 17 or more than one powered unit 17 may utilize one or more of the above-mentioned position determination device(s) to determine a distance estimation and a quality value of a respective distance estimation to each powered unit 17. By utilizing more than one position determination device 24, a more accurate distance estimation and quality value of the distance estimation may be achieved. For example, if ten position determination devices 24 were utilized and provide distances in the range of 21.3 to 21.4 miles (e.g., 34.3 to 34.4 km), a relatively good quality value would accompany a distance estimation in that range. If fewer (e.g., two) position determination devices 24 were utilized and provide distances of 25 and 30 miles (e.g., 40 to 48 km), a relatively bad quality value would accompany a distance estimation based on these distances. In an example embodiment, in determining the distance estimation 14, a second controller (see below) may compute an average, median, standard deviation, or other statistical measure of a plurality of distance estimations 14 provided from a plurality of position determination devices 24. For example, if ten position determination devices 24 provide ten distance estimations with an average of 21.3 miles (e.g., 34.3 km), this average may be used to calculate the quality value of a distance estimation that is used to control operations of the powered system 16 and/or to direct the operator to control operations of the powered system 16. However, the second controller may evaluate the standard deviation of these ten distances, which for example may range between 18 to 27 miles (e.g., 29 and 43 km), and thus, may base the quality value of the distance estimation on the standard deviation.

The controller 34 is coupled to the position determination device 24. The controller 34 converts the measured position of the powered system 16 into a second distance 32 of the powered system 16 along the route 20. The second distance 32 may be referred to as a position-based distance. The controller 34 can determine the second distance 32 based on a memory 36 of the controller 34 that stores the second distance 32 of the powered system 16 along the route 20. The memory 36 can store a list of the measured positions (e.g., in terms of latitude/longitude) for the entire route 20, and the distance of each measured position from the reference point 13 along the route 20 as the second distance 32. Although the position determination device 24 illustrated in FIG. 1 can transmit a measured position to the controller 34 which is subsequently converted to the second distance 32 from the reference point 13 along the route 20 by the controller 34, the position determination device 24 may perform this conversion and store the second distance 32 in an internal memory similar to the memory 36 of the controller 34. The position determination device 24 can output an uncertainty signal 38 to a second controller (see below) for determining the third quality value 12 of the distance estimation 14. The uncertainty signal 38 is indicative of a level of uncertainty in the measured position of the train 16, and may be reflective of the number of global positioning satellites 44, 46 in sufficient communication with the position determination device 24, for example. The uncertainty signal 38 may represent or be a dilution of precision (DOP) value, which is a unitless value between 1 and 5, where a higher number if indicative of greater uncertainty in the measured position of the powered system 16. Alternatively, the uncertainty signal 38 may represent a deviation (e.g., a standard deviation, variance measurement, and the like) of several distance estimations 14.

The evaluation system 10 can further include a second controller 28 configured to determine the distance estimation 14 of the powered system 16 at the location 18 along the route 20 and/or the third quality value 12 of the distance estimation 14 of the powered system 16 at the location 18 along the route 20. As illustrated in FIG. 1, the second controller 28 can determine the distance estimation 14 and the third quality value 12 of the distance estimation 14 based upon several input parameters, such as the first distance 30 of the powered system 16 along the route 20 that is based on the speed of the powered system 16, the second distance 32 of the powered system 16 along the route 20 that is based on the measured position of the powered system 16, the uncertainty signal 39 provided from the speed sensor 22, and/or the uncertainty signal 38 provided from the position determination device 24. The second controller 28 may base the determination of the distance estimation 14 and the third quality value 12 based on less than or more than these input parameters. In one example embodiment, the second controller includes or represents a Kalman filter. For example, the second controller may determine the distance estimation 14 and the quality value 12 using the speed-based distance estimation and the location-based distance estimation as inputs into a Kalman filter.

As further illustrated in the example embodiment of FIG. 1, the second controller 28 includes a memory 42. The memory 42 stores prior distance estimations and respective prior quality values for previous locations spaced apart from the location 18 along the route 20. As illustrated in the embodiments shown in FIGS. 3 and 4, which represent time plots of the first and third quality values 11 (FIG. 3), 12 (FIG. 5) of the distance estimation 14 over time (where time is represented by horizontal axes 202 and 402 in FIGS. 3 and 5, respectively), during a first time period 40 (approximately t=2500 to 3000 in FIGS. 3 and 5), the transceiver 24 provides a measured position of the train 16. During this first time period 40, the second controller 28 determines the first and third quality values 11, 12 of distance estimation 14 based on the first distance 30, the second distance 32, the uncertainty signal 38, and the prior quality values provided from the second controller memory 42. Although one example embodiment of the inventive subject matter involves the second controller 28 determining the first and third quality values 11, 12 based on the first distance 30, the second distance 32, the uncertainty signal 38, and the prior quality values, the second controller 28 may determine the first and third quality values 11, 12 based on less or more than these values. The third quality value 12 of the illustrated embodiment of FIG. 5 (as shown alongside a vertical axis 400 which is measured in feet) is based on the absolute value of the first quality value 11 of the example embodiment of FIG. 3 (as represented along a vertical axis 200), with the exception of a second time period 48 when the position determination device 24 fails to provide a measured position of the powered system 16 (discussed below). As an example, if at a time $t_1$=2600 during the first time period 40, the first distance 30 is 100 feet (e.g., 30.5 meters), the second distance 32 is 95 feet (e.g., 28.9 meters), the uncertainty signal 38 is 4 (e.g., high or significant uncertainty), and a prior quality value before $t_1$ was 3 feet (e.g., 0.9 meters), the second controller 28 may determine that the third quality value 12 is 4 feet (e.g., 1.2 meters). Since the uncertainty signal 38 was relatively high, the second controller 28 may increase the third quality value 12 from a prior value of 3 feet (e.g., 0.9 meters) to the value of 4 feet (e.g., 1.2 meters). Thus, the second controller 28 can continuously or periodically propagate the third quality value 12 based on the uncertainty signal 38, the first distance 30, the second distance 32, and one or more prior quality values. Also, the second controller 28 can compute the distance estimation 14 by adding the third quality value 12 to the second distance 32 (if the second distance 32 is less than the first distance 30), or by subtracting the third quality value 12 from the second distance 32 (if the second distance 32 is greater than the first distance 30). In this example, the second distance 32 is less than the first distance 30, so the second controller 28 adds the third quality value 12 to the second distance 32 to arrive at the distance estimation 14 (e.g., 95 feet+4 feet=99 feet). To continue this example, at a second time $t_2$=2800 during the first time period 40, the first distance 30 is 250 feet (e.g., 76.2 meters), the second distance 32 is 240 feet (e.g., 73.2 meters), the uncertainty signal 38 is 2 (e.g., relatively low uncertainty), and the previous third quality value 12 was 3 feet (0.9 meters), as previously computed. Since the uncertainty signal 38 is relatively low, the second controller 28 can decrease the third quality value 12 from a prior value of 4 feet (e.g., 1.2 meters), to the value of 3 feet (e.g., 0.9 meters), for example. Additionally, the second controller 28 can compute the distance estimation 15 (FIG. 2) of the powered system 16 at the later time $t_2$ to be the sum of the second distance 32 and the new third quality value 12 (e.g., 240 feet+3 feet=243 feet). FIG. 2 illustrates the distance estimations 14, 15 of the powered system 16 at the respective times $t_1$, $t_2$. The numeric distances are provided as examples, and thus the second controller 28 may determine the same or different values as those above.

The speed sensor 22 can continuously or periodically measure the speed of the powered unit 17 and/or continuously or periodically provide the speed data to the controller 34. The second controller 28 also may receive the first distances 30 on a continuous or periodic time interval basis. The position determination device 24 may not continuously or periodically provide measured positions of the powered system 16, but may instead provide the measured positions at diluted time intervals, such as times that are based on the availability of the message signals from the satellites 44, 46, in addition to other factors, such as in response to manual and/or automatically generated prompts, for example. Thus, the second controller 28 can receive the second distance 32 data from the controller 34 on a diluted time interval basis. Based on the difference in the repeated (e.g., continuous or periodic) and diluted time intervals of the respective first and second distances 30, 32 provided to the second controller 28, the second controller 28 can dynamically determine the third quality value 12 of the distance estimations on a diluted time interval basis, which effectively acts as a correction to the first distance 30 provided on the continuous or periodic time interval basis.

Figure 5:
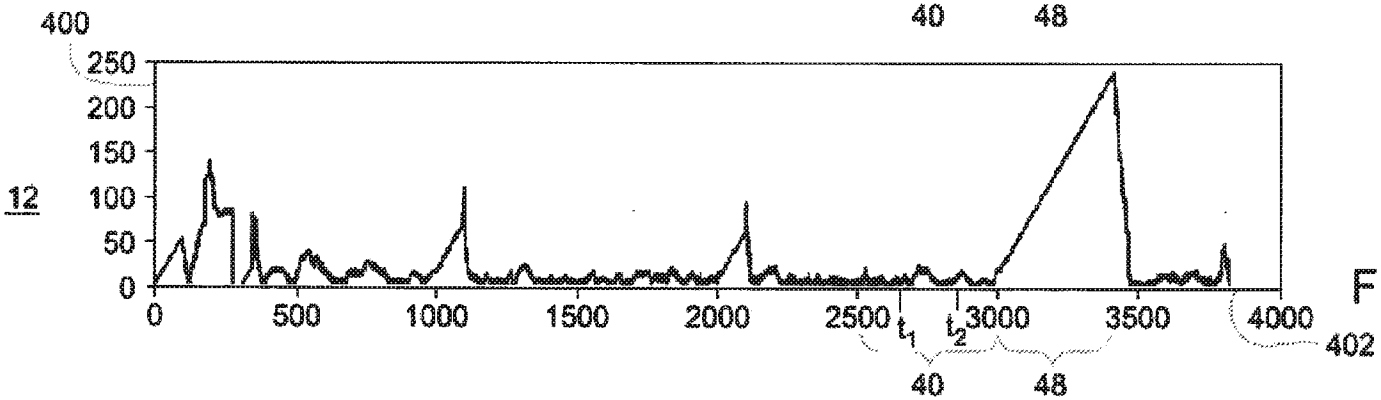
FIG. 5 is a plot of one example embodiment of a third quality value of a distance estimation of the powered system at a plurality of locations along a route.

As further illustrated in the exemplary embodiment of FIGS. 3 and 5, during a second time period 48 (approximately t=3000-3500), the position determination device 24 ceases to provide the measured position of the powered system 16 or position data that can be used to determine the measured position of the powered system 16. To determine if the position determination device 24 has ceased to provide a measured position of the powered system 16, the controller 34 compares the first distance 30 and the second distance 32 to determine a precision of the second distance 32 relative to the first distance 30. The controller 34 can determine if the precision falls below a threshold level for at least a threshold period of time. If the controller 34 determines that the position determination device 24 has not provided any measured position or position data for at least the threshold period of time, or that the measured position or position data is not adequately precise, the controller 34 may send a modification signal to the second controller 28 to direct the second controller 28 to modify the method used by the second controller 28 to compute the third quality value 12 of the distance estimation 14, as discussed below. During the second time period 48, the first quality value 11 in FIG. 3 is essentially flat, as in this particular embodiment, the second controller 28 equates the current quality value with the prior quality value. For the third quality value 12 of the distance estimation 14 in the embodiment of FIG. 5, however, the second controller 28 can determine an increase in the third quality value 12 based on a quality value prior to the position determination device 24 having ceased to provide a measured position of the powered system 16 and based on a pair of configurable constants K1, K2 (which are based on an uncertainty in the speed of the powered system 16) as follows:

$$\text{Quality Value Increase}(t)=K2*\text{Previous Value Quality}*t+K1*t \quad \text{(Eqn. 1)}$$

Accordingly, during the initial portion of the second time period 48 in FIG. 5, the third quality value 12 essentially is an increasing line having a slope based on the product of the previous quality value prior to the position determination device 24 having ceased to provide a measured position or position data and a configurable constant K2 that is based on the speed uncertainty 39. During the second time period 48, when the position determination device 24 has resumed communication with the controller 34, the second controller 28 can determine a decrease in the third quality value 12 based on the previous quality value prior the position determination device 24 starting to resume communication to provide a measured position of the powered system 16 and a skew based on the position uncertainty signal 38, as follows:

$$\text{Quality Value Decrease}(t)=\text{Previous Quality Value}+\text{skew(based on position uncertainty signal)} \quad \text{(Eqn. 2)}$$

Accordingly, as the value of the position uncertainty signal 38 that is provided from the position determination device 24 decreases, the greater the decrease in the quality value back down to the range of quality values prior to the position determination device 24 having ceased to provide the measured position. The third quality value 12 can increase once the position determination device 24 ceases to provide a measured position since only one distance measurement (e.g., the speed-based distance 30) is being utilized to determine the location of the powered system 16, and the distance measurement that is based on the location data provided by the position determination device 24 will not be relied upon significantly until the position uncertainty signal 38 is once again relatively low.

Figure 6:
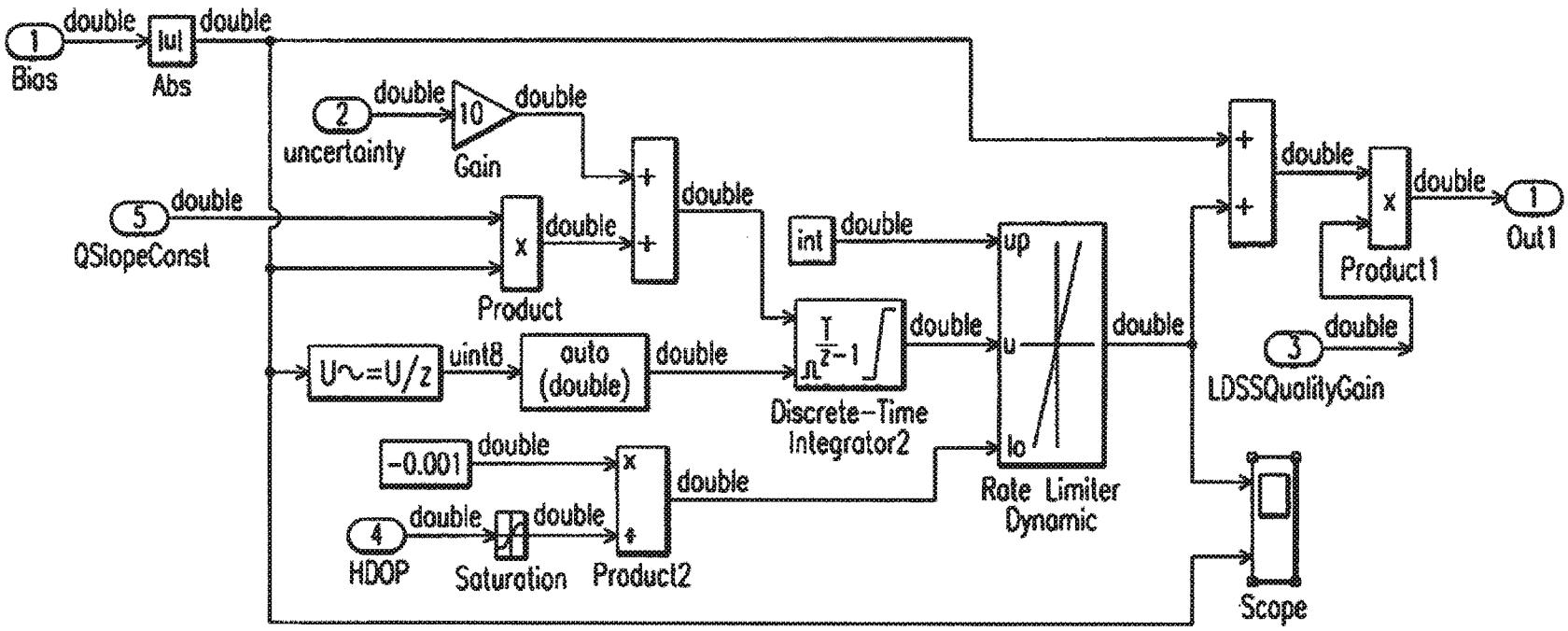
FIG. 6 is a block diagram of one example embodiment of a second controller configured to determine a quality value of a distance estimation of a powered system at a plurality of locations along a route.

The controller 34 may operate according to a trip plan to autonomously control operations of the powered system 16 according to designated operational parameters of a trip plan and/or to direct an operator of the powered system 16 to manually control operations of the powered system 16 according to the operational parameters of the trip plan. The trip plan may include designated (e.g., predetermined) operational parameters of the powered system 16, such as operational settings (e.g., throttle settings, brake settings, speeds, accelerations, braking efforts, and the like). The operational parameters may be expressed as a function of position along the route or distance traveled along the route during the trip. The controller 34 may automatically control the powered system 16 according to the trip plan, such as by implementing the designated operational parameters of the powered system 16 when the powered system 16 reaches a corresponding position or distance traveled in the trip. Alternatively or additionally, the controller 34 may direct an operator of the powered system 16 to manually implement the designated operational parameters, such as by displaying or otherwise presenting instructions to the operator on how to control the actual parameters of the powered system 16 to match the designated operational parameters of the trip plan when the powered system 16 reaches the corresponding location or distance of the trip plan. In one embodiment, the controller 34 determines or obtains initial designated parameters of a trip plan for the powered system 16 for each location or several different locations along the route 20 prior to the powered system 16 commencing a trip along the route 20 or while the powered system 16 is traveling along the route 20. The controller 34 can use the distance estimation 14 and the third quality value 12 of the distance estimation 14 to control the actual parameters of the powered system. For example, the controller 34 can manually direct the operator or automatically adjust the actual parameters of the powered system 16 to match or approach the designated parameters of the trip plan at one or more upcoming locations 19 (FIG. 2) along the route 20 as the powered system 16 travels along the route 20. For example, the controller 34 in the automatic mode may use the distance estimation 14 and the third quality value 12 at the initial location 18, in a worse case scenario, when determining when to change actual parameters of the powered system 16 to the designated parameters planned for the upcoming location 19. For example, if the third quality value 12 of the distance estimation 14 is 10 feet (e.g., 3.0 meters), then the controller 34 may plan to modify the actual parameters of the powered system 16 to match or approach the designated parameters of the trip plan that are associated with the upcoming location 19 in the trip plan to a location that is 10 feet (e.g., 3.0 meters) short of the upcoming location 19. The controller 34 may use the distance estimation 15 of the upcoming location 19 to confirm when the powered system 16 actually is at the upcoming location 19 to track the accuracy of the actual parameters of the powered system 16 relative to the designated parameters of the trip plan at the upcoming location 19, such as by determining differences between the actual and designated parameters. In one embodiment, if the designated parameter dictates the speed of the powered system 16, the distance estimation 14 and the third quality value 12 of the distance estimation 14 may be utilized to adjust the actual speed of the powered system 16 at a distance prior to the upcoming location 19 of the powered system 16 (where the third quality value 12 may be used to determine the distance prior to the upcoming location 19), so that the powered system 16 complies with a speed restriction at the upcoming location 19 along the route 20. The controller 34 can be switchable from an automatic mode where parameters of the powered system 16 are automatically controlled according to the trip plan to a manual mode, in which the controller 34 directs the operator how to control the parameters of the powered system 16 according to the trip plan. The controller 34 can be configured to switch from the automatic mode to the manual mode when the third quality value 12 is outside a predetermined acceptable range stored in the memory 36 of the controller 34. FIG. 6 illustrates an example embodiment of a block diagram of the internal operations of the second controller 28. FIG. 6 is one example of a block diagram arrangement of the second controller 28, and other various block diagram arrangements are possible.

Figure 7:
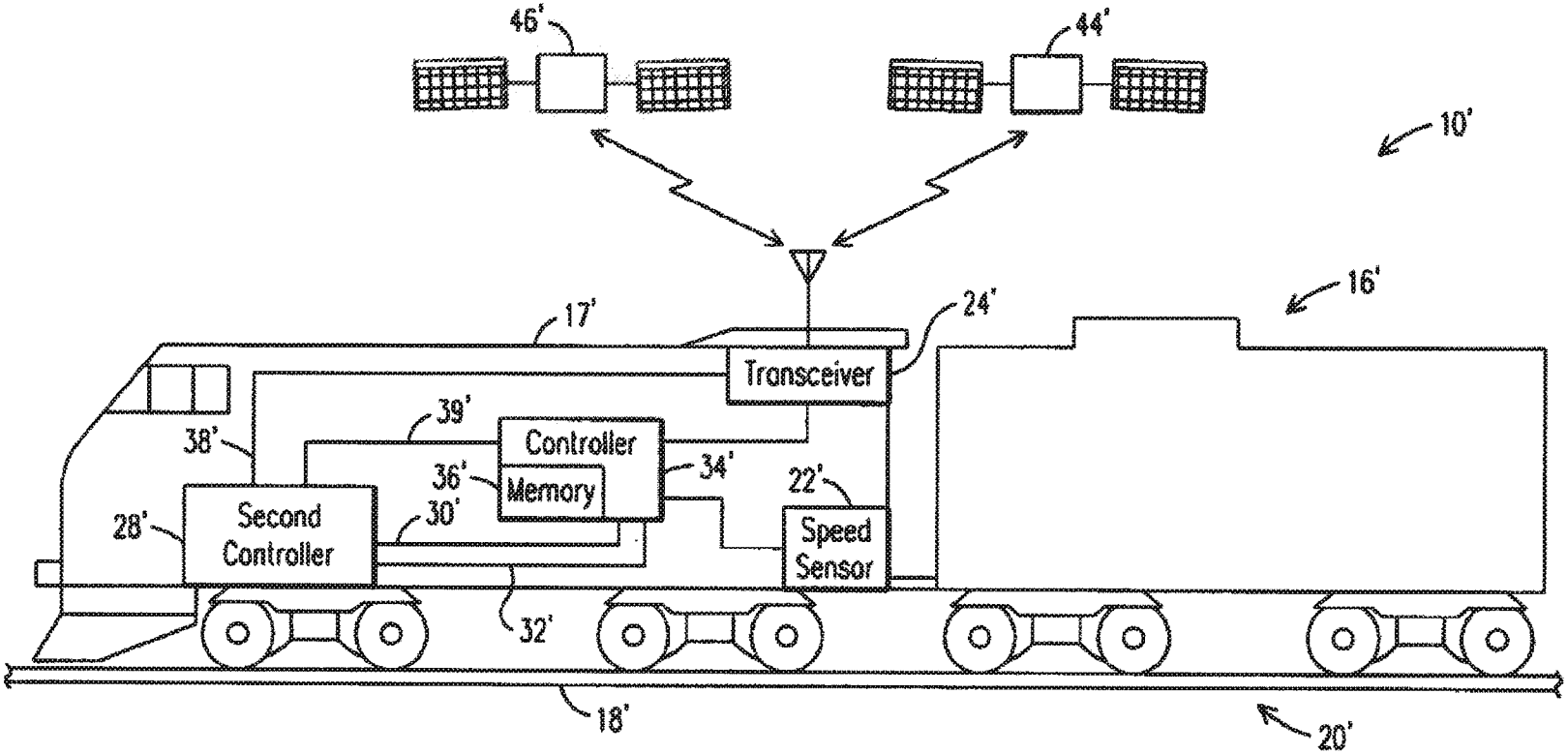
FIG. 7 is a side plan view of one example embodiment of a system for determining a quality value of a distance estimation of a powered system at a location along a route.

FIG. 7 illustrates an additional embodiment of an evaluation system 10' for determining a second quality value 12' (FIG. 4) of a distance estimation of a powered system 16' at a location 18' along a route 20'. The second quality value 12' is shown alongside a horizontal axis 302 representative of time and a vertical axis 300 that is representative of the values of the second quality value 12' in feet. The system 10' includes a speed sensor 22' to determine speed data that is representative of the speed of the powered system 16' at the location 18' along the route 20'. The system 10' further includes a position determination device 24' (e.g., transceiver or receiver, and associated communication circuitry) to obtain position data representative of a position of the powered system 16'. The system 10' further includes a second controller 28' to determine the second quality value 12' of the distance estimation during a first time period 40' when the position determination device 24' measures the position of the powered system 16'. As illustrated in the plots of FIG. 4 and FIG. 7, the second quality value 12' is based on the uncertainty signal 38' and an uncertainty signal 39' in the speed of the powered system 16'. Although the example embodiment describes that the second quality value 12' is based on the sum of the uncertainties in the measured position and the speed, the second quality value 12' may be based on only one of these uncertainties. As shown in the plot of FIG. 4 during the second time period 48, the second quality value 12' increases to a large number (approx 4000 feet) due at least in part to the second quality value 12' being based on the sum of the uncertainties in the speed and the measured position. Other versions of the system 10' may be adjusted, however, such that the second quality value 12' does not increase to such large amounts. The second controller 28' can be configured to determine the distance estimation based upon the first distance 30', the second distance 32', and the second quality value 12' of the distance estimation.

One or more functions of operating or controlling the powered system 16 may change responsive to the quality value of the distance estimation or changes in the quality value. As described above, the controller 34 may rely on the distance estimation 14 to automatically control operations of the powered system 16 according to a trip plan. In one embodiment, the controller 34 may switch from automatic control of the powered system 16 to manual control of the powered system 16 when the quality value of the distance estimation falls outside of a designated range. For example, when the quality value indicates that the distance estimation is less reliable than before or is no longer reliable, then the controller 34 may stop autonomous control of the powered system 16 and may switch to a manual control to allow the operator to take over manual control of the powered system 16. Alternatively, the controller 34 may not switch from automatically controlling operations of the powered system 16 to manual control of the powered system 16 if the powered system 16 is traveling less than a speed limit. For example, if the speed data from the speed sensor 22 indicates that the powered system 16 is traveling slower than a speed limit of the route 20 by at least a designated amount, then the controller 34 may remain in an automatic mode to autonomously control the operations of the powered system 16, even if the quality value of the distance estimation falls outside of the designated range.

In another embodiment, the controller 34 may present (e.g., visually display on an output device, such as a display device in the powered unit 17) a rolling map to an operator of the powered system 16. The rolling map may represent where the powered system 16 is located that changes as the powered system 16 moves. The portion of the map that is currently displayed to the operator may be based on the distance estimation 14. When the quality value indicates that the distance estimation 14 is less reliable than before or is no longer reliable, then the controller 34 may stop presenting the rolling map to the operator.

Figure 8:
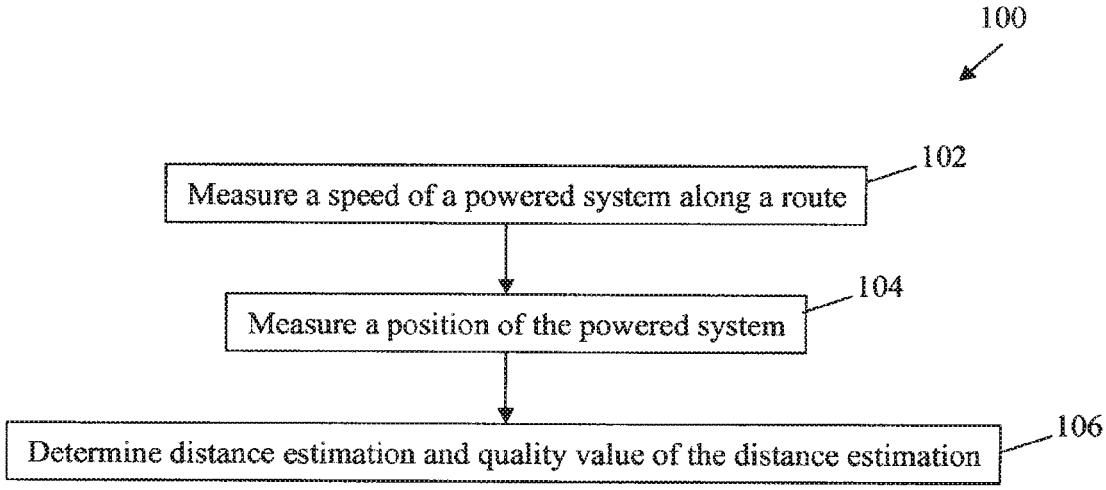
FIG. 8 is a flow chart illustrating one example embodiment of a method for determining a quality value of a distance estimation of a powered system at a location along a route.

FIG. 8 illustrates a flow chart of an exemplary embodiment of a method 100 for determining a quality value 12 of a distance estimation 14 of a powered system 16 at a location 18 along a route 20. At 102, a speed of the powered system 16 is measured at the location 18 along the route 20. At 104, a position of the powered system is measured 16. At 106, the distance estimation 14 of the powered system 16 along the route 20 and the quality value 12 of the distance estimation 14 are determined. The distance estimation 14 and/or the quality value 12 may be based on a first distance 30 of the powered system 16 along the route 20 (which can be based on the speed of the powered system 16) and on a second distance 32 of the powered system 16 along the route 20 (which can be based on the measured position of the powered system 16).

In another embodiment, a system (e.g., a control system) includes a speed sensor, a position determination device, and at least one controller. The speed sensor is configured to output speed data representative of a measured speed at which a powered system is traveling at a location. The position determination device is configured to output location data representative of a measured position of the powered system at the location. The at least one controller is configured to determine a location estimation of the powered system based on a speed-based distance estimation and a position-based distance estimation of the powered system from one or more reference points. The speed-based distance estimation is based at least in part on the measured speed and the position-based distance estimation is based at least in part on the measured position. The at least one controller is configured to determine a quality value of the location estimation that is based at least in part on the location estimation and the measured position of the powered system. The powered system is a rail vehicle consist comprising at least one rail vehicle having the speed sensor, the position determination device, and the at least one controller.

In another aspect, the at least one controller is configured to convert the measured position of the powered system into the position-based distance estimation of the powered system along a route from the one or more reference points along the route based on one or more previously measured positions and corresponding position-based distance estimations from the one or more reference points along the route.

In another aspect, the speed sensor is configured to provide a speed uncertainty signal to the at least one controller that is indicative of a level of uncertainty in the measured speed. The at least one controller is configured to determine the quality value of the location estimation based at least in part on the speed uncertainty signal.

In another aspect, the speed uncertainty signal is a predefined signal having at least one of a constant value or a manually controllable value.

In another aspect, the position determination device is configured to provide a location uncertainty signal to the at least one controller that is indicative of a level of uncertainty in the measured position. The at least one controller can be configured to determine the quality value of the location estimation based on the location uncertainty signal.

In another aspect, the at least one controller is configured to determine the quality value of the location estimation based on one or more previously acquired quality values.

In another aspect, the position determination device is at least one global positioning system (GPS) receiver configured to communicate with one or more global positioning satellites to determine the location data.

In another aspect, the location estimation of the powered system at the location is based on at least one of a sum of or difference between the quality value of the location estimation and at least one of the speed-based distance estimation or the measured position.

In another aspect, the at least one controller is configured to receive the speed data from the speed sensor more frequently than the at least one controller receives the location data from the position determination device.

In another aspect, the position determination device is configured to periodically provide the location data to the at least one controller and the at least one controller is configured to determine the quality value based on a prior quality value that is determined at one or more times between when the location data is periodically provided to the at least one controller.

In another aspect, the at least one controller is configured to decrease the quality value when the position determination device fails to provide the location data to the at least one controller.

In another aspect, the at least one controller is configured to compare the speed-based distance estimation and the measured position to determine a precision of the measured position relative to the speed-based distance estimation.

In another aspect, the at least one controller is configured to at least one of autonomously control or direct manual control of operations of the powered system during a trip along a route according to a trip plan. The trip plan designates operational parameters of the powered system as a function of distance along the route. The at least one controller can be configured to determine which of the operational parameters designated by the trip plan to use to control the powered system based on the location estimation.

In another aspect, the operational parameters that are designated by the trip plan are designated speeds of the powered system.

In another aspect, the at least one controller is configured to stop autonomously controlling the operations of the powered system during the trip when the quality value changes to a value that is outside of a designated range.

In another aspect, the at least one controller is configured to continue autonomously controlling the operations of the powered system during the trip when the measured speed of the powered system is less than a speed limit of the route by at least a designated amount even if the quality value is outside of the designated range.

In another aspect, if the quality value is within a designated range, the at least one controller is configured to present a map to an operator of the powered system that indicates where the powered system is located based on the location estimation and, if the quality value is outside of the designated range, the at least one controller is configured to stop presenting the map.

In another aspect, the at least one controller is configured to use the speed-based distance estimation and the position-based distance estimation as inputs into a Kalman filter to determine the location estimation and the quality value.

In another embodiment, another system (e.g., a control system) includes a speed sensor, a position determination device, and at least one controller. The speed sensor is configured to output speed data representative of a measured speed at which a powered system is traveling at a location. The position determination device is configured to output location data representative of a measured position of the powered system at the location. The at least one controller is configured to determine a location estimation of the powered system from one or more reference points, based at least in part on the measured speed and the measured position, and the at least one controller is configured to determine a quality value of the location estimation that is based at least in part on the location estimation and the measured position of the powered system.

In another aspect, the at least one controller is configured to determine the location estimation of the powered system based on a speed-based distance estimation and a position-based distance estimation of the powered system. The speed-based distance estimation can be based at least in part on the measured speed and the position-based distance estimation can be based at least in part on the measured position.

In another embodiment, a method (e.g., for controlling a powered system) includes receiving speed data from a speed sensor disposed onboard a first rail vehicle of a rail vehicle consist. The speed data is representative of a measured speed at which the rail vehicle consist is traveling at a location. The method also includes receiving location data from a position determination device disposed onboard the first rail vehicle of the rail vehicle consist. The location data is representative of a measured position of the rail vehicle consist at the location. The method further includes determining a speed-based distance estimation of the rail vehicle consist based at least in part on the speed data. The speed-based distance estimation is representative of separation of the rail vehicle consist from one or more reference points. The method also includes determining a position-based distance estimation of the rail vehicle consist based at least in part on the location data. The position-based distance estimation is representative of the separation of the rail vehicle consist from the reference point. The method further includes determining a location estimation of the rail vehicle consist based at least in part on the speed-based distance estimation and the position-based distance estimation and determining a quality value of the location estimation based at least in part on the location estimation and the measured position of the rail vehicle consist.

In another aspect, the method also includes receiving at least one of a speed uncertainty signal from the speed sensor that is indicative of a level of uncertainty in the measured speed or receiving a location uncertainty signal from the position determination device that is indicative of a level of uncertainty in the measured position. The quality value of the location estimation is determined based at least in part on at least one of the speed uncertainty signal or the location uncertainty signal.

In another aspect, the quality value of the location estimation is determined based on one or more previously acquired quality values.

In another aspect, the method also includes at least one of autonomously controlling or directing manual control of operations of the rail vehicle consist during a trip along a route according to a trip plan. The trip plan designates speeds of the rail vehicle consist as a function of distance along the route. The method can also include controlling actual speeds of the rail vehicle consist to match one or more of the speeds designated by the trip plan based on the location estimation.

In another aspect, the method also includes stopping autonomous control of the rail vehicle consist according to the trip plan when the quality value changes to a value that is outside of a designated range.

In another aspect, the method includes, if the quality value is within a designated range, presenting a map to an operator of the powered system that indicates where the rail vehicle consist is located based on the location estimation and, if the quality value is outside of the designated range, stopping presentation of the map.

In another embodiment, another method (e.g., for controlling a powered system) includes receiving speed data from a speed sensor disposed onboard a first rail vehicle of a rail vehicle consist. The speed data is representative of a measured speed at which the rail vehicle consist is traveling at a location. The method also includes receiving location data from a position determination device disposed onboard the first rail vehicle of the rail vehicle consist. The location data is representative of a measured position of the rail vehicle consist at the location. The method further includes determining a location estimation of the rail vehicle consist from one or more reference points based at least in part on the speed data and the location data and determining a quality value of the location estimation based at least in part on the location estimation and the measured position of the rail vehicle consist.

In another aspect, the method also includes determining a speed-based distance estimation of the rail vehicle consist based at least in part on the speed data. The speed-based distance estimation is representative of separation of the rail vehicle consist from the one or more reference points. The method can also include determining a position-based distance estimation of the rail vehicle consist based at least in part on the location data, where the position-based distance estimation is representative of the separation of the rail vehicle consist from the one or more reference points. The location estimation of the rail vehicle consist can be determined based at least in part on the speed-based distance estimation and the position-based distance estimation.

In another embodiment, another system (e.g., a control system) includes a speed sensor, a position determination device, and one or more controllers. The speed sensor is for generating speed data that represents a velocity of a vehicle system along a route. The position determination device is for generating location data that represents a position of the vehicle system along the route. The one or more controllers are for determining a speed-based distance of the vehicle system from a reference location based on the speed data and for determining a location-based distance of the vehicle system from the reference location based on the location data. The one or more controllers also are for determining a location estimation of the vehicle system along the route based on the speed-based distance and the location-based distance and for determining a quality value of the location estimation based on the location data. The one or more controllers also are for at least one of autonomously controlling or directing manual control of the velocity of the vehicle system according to a trip plan that designates speeds of the vehicle system as a function of distance along the route. The one or more controllers also are for using the location estimation to determine the velocity of the vehicle system according to the trip plan responsive to the quality value remaining within a designated range.

In another aspect, the one or more controllers are configured to cease the at least one of autonomously controlling or directing manual control of the velocity of the vehicle system according to the trip plan responsive to the quality value being outside of the designated range.

In another aspect, the one or more controllers are configured to continue the at least one of autonomously controlling or directing manual control of the velocity of the vehicle system according to the trip plan even when the quality value is outside of the designated range if the velocity of the vehicle system is less than a designated speed limit of the route by at least a designated amount.

In another aspect, the one or more controllers also are for presenting a map to an operator of the vehicle system to notify the operator of where the vehicle system is located along the route, the one or more controllers configured to stop presenting the map to the operator responsive to the quality value being outside of the designated range.

In another aspect, the speed sensor is configured to provide a speed uncertainty signal that is representative of uncertainty in an accuracy of the speed data. The one or more controllers can be configured to determine the quality value based on the speed uncertainty signal.

In another aspect, the position determination device is configured to provide a position uncertainty signal that is representative of uncertainty in an accuracy of the location data. The one or more controllers can be configured to determine the quality value based on the position uncertainty signal.

In another aspect, the vehicle system is a rail vehicle consist having a locomotive, and the speed sensor, the position determination device, and the one or more controllers are disposed onboard the locomotive.

This written description uses examples to disclose embodiments of the inventive subject matter and to enable a person of ordinary skill in the art to make and use the embodiments of the inventive subject matter. The patentable scope of the embodiments of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

That which is claimed is:

1. A system comprising:

a speed sensor configured to output speed data representative of a measured speed at which a powered system is traveling at a location;

a position determination device configured to output location data representative of a measured position of the powered system at the location; and at least one controller configured to determine a location estimation of the powered system based on a speed-based distance estimation and a position-based distance estimation of the powered system from one or more reference points, the speed-based distance estimation based at least in part on the measured speed and the position-based distance estimation based at least in part on the measured position, and the at least one controller is configured to determine a quality value of the location estimation that is based at least in part on the location estimation and the measured position of the powered system, wherein the powered system is a rail vehicle consist comprising at least one rail vehicle having the speed sensor, the position determination device, and the at least one controller, wherein the at least one controller is configured to at least one of autonomously control or direct manual control of operations of the powered system during a trip along a route according to a trip plan, the trip plan designating operational parameters of the powered system as a function of distance along the route, and wherein the at least one controller is configured to determine which of the operational parameters designated by the trip plan to use to control the powered system based on the location estimation.

2. The system of claim 1, wherein the at least one controller is configured to convert the measured position of the powered system into the position-based distance estimation of the powered system along the route from the one or more reference points along the route based on one or more previously measured positions and corresponding position-based distance estimations from the one or more reference points along the route.

3. The system of claim 1, wherein the speed sensor is configured to provide a speed uncertainty signal to the at least one controller that is indicative of a level of uncertainty in the measured speed, and wherein the at least one controller is configured to determine the quality value of the location estimation based at least in part on the speed uncertainty signal.

4. The system of claim 3, wherein the speed uncertainty signal is a predefined signal having at least one of a constant value or a manually controllable value.

5. The system of claim 1, wherein the position determination device is configured to provide a location uncertainty signal to the at least one controller that is indicative of a level of uncertainty in the measured position, and wherein the at least one controller is configured to determine the quality value of the location estimation based on the location uncertainty signal.

6. The system of claim 1, wherein the at least one controller is configured to determine the quality value of the location estimation based on one or more previously acquired quality values.

7. The system of claim 1, wherein the position determination device is at least one global positioning system (GPS) receiver configured to communicate with one or more global positioning satellites to determine the location data.

8. The system of claim 1, wherein the location estimation of the powered system at the location is based on at least one of a sum of or difference between the quality value of the location estimation and at least one of the speed-based distance estimation or the measured position.

9. The system of claim 1, wherein the at least one controller is configured to receive the speed data from the speed sensor more frequently than the at least one controller receives the location data from the position determination device.

10. The system of claim 1, wherein the position determination device is configured to periodically provide the location data to the at least one controller and the at least one controller is configured to determine the quality value based on a prior quality value that is determined at one or more times between when the location data is periodically provided to the at least one controller.

11. The system of claim 1, wherein the at least one controller is configured to decrease the quality value when the position determination device fails to provide the location data to the at least one controller.

12. The system of claim 1, wherein the at least one controller is configured to compare the speed-based distance estimation and the measured position to determine a precision of the measured position relative to the speed-based distance estimation.

13. The system of claim 1, wherein the operational parameters that are designated by the trip plan are designated speeds of the powered system.

14. The system of claim 1, wherein the at least one controller is configured to stop autonomously controlling the operations of the powered system during the trip when the quality value changes to a value that is outside of a designated range.

15. The system of claim 14, wherein the at least one controller is configured to continue autonomously controlling the operations of the powered system during the trip when the measured speed of the powered system is less than a speed limit of the route by at least a designated amount even if the quality value is outside of the designated range.

16. The system of claim 1, wherein:

if the quality value is within a designated range, the at least one controller is configured to present a map to an operator of the powered system that indicates where the powered system is located based on the location estimation, and if the quality value is outside of the designated range, the at least one controller is configured to stop presenting the map.

17. The system of claim 1, wherein the at least one controller is configured to use the speed-based distance estimation and the position-based distance estimation as inputs into a Kalman filter to determine the location estimation and the quality value.

18. A system comprising:

a speed sensor configured to output speed data representative of a measured speed at which a rail vehicle consist is traveling at a location;

a position determination device configured to output location data representative of a measured position of the rail vehicle consist at the location; and at least one controller configured to determine a location estimation of the rail vehicle consist from one or more reference points, based at least in part on the measured speed and the measured position, and the at least one controller is configured to determine a quality value of the location estimation that is based at least in part on the location estimation and the measured position of the rail vehicle consist, wherein the location estimation of the powered system at the location is based on at least one of a sum of or difference between the quality value of the location estimation and at least one of a speed-based distance estimation from at least one of the one or more reference points or the measured position.

19. The system of claim 18, wherein the at least one controller is configured to determine a position-based distance estimation of the rail vehicle consist, and wherein the speed-based distance estimation is based at least in part on the measured speed and the position-based distance estimation is based at least in part on the measured position.

20. A method comprising:

receiving speed data from a speed sensor disposed onboard a first rail vehicle of a rail vehicle consist, the speed data representative of a measured speed at which the rail vehicle consist is traveling at a location;

receiving location data from a position determination device disposed onboard the first rail vehicle of the rail vehicle consist, the location data representative of a measured position of the rail vehicle consist at the location;

determining a speed-based distance estimation of the rail vehicle consist based at least in part on the speed data, the speed-based distance estimation representative of separation of the rail vehicle consist from one or more reference points;

determining a position-based distance estimation of the rail vehicle consist based at least in part on the location data, the position-based distance estimation representative of the separation of the rail vehicle consist from the reference point;

determining a location estimation of the rail vehicle consist based at least in part on the speed-based distance estimation and the position-based distance estimation;

determining a quality value of the location estimation based at least in part on the location estimation and the measured position of the rail vehicle consist;

at least one of autonomously controlling or directing manual control of operations of the rail vehicle consist during a trip along a route according to a trip plan, the trip plan designating speeds of the rail vehicle consist as a function of distance along the route; and controlling actual speeds of the rail vehicle consist to match one or more of the speeds designated by the trip plan based on the location estimation.

21. The method of claim 20, further comprising receiving at least one of a speed uncertainty signal from the speed sensor that is indicative of a level of uncertainty in the measured speed or receiving a location uncertainty signal from the position determination device that is indicative of a level of uncertainty in the measured position, and wherein the quality value of the location estimation is determined based at least in part on at least one of the speed uncertainty signal or the location uncertainty signal.

22. The method of claim 20, wherein the quality value of the location estimation is determined based on one or more previously acquired quality values.

23. The method of claim 20, further comprising stopping autonomous control of the rail vehicle consist according to the trip plan when the quality value changes to a value that is outside of a designated range.

24. The method of claim 20, further comprising:

if the quality value is within a designated range, presenting a map to an operator of the powered system that indicates where the rail vehicle consist is located based on the location estimation; and if the quality value is outside of the designated range, stopping presentation of the map.

25. A method comprising:

receiving speed data from a speed sensor disposed onboard a first rail vehicle of a rail vehicle consist, the speed data representative of a measured speed at which the rail vehicle consist is traveling at a location;

receiving location data from a position determination device disposed onboard the first rail vehicle of the rail vehicle consist, the location data representative of a measured position of the rail vehicle consist at the location;

determining a location estimation of the rail vehicle consist from one or more reference points based at least in part on the speed data and the location data; and determining a quality value of the location estimation based at least in part on the location estimation and the measured position of the rail vehicle consist, wherein the location estimation of the powered system at the location is based on at least one of a sum of or difference between the quality value of the location estimation and at least one of a speed-based distance estimation of the rail vehicle consist from one or more reference locations or the measured position of the rail vehicle consist.

26. The method of claim 25, further comprising:

determining the speed-based distance estimation of the rail vehicle consist based at least in part on the speed data, the speed-based distance estimation representative of separation of the rail vehicle consist from the one or more reference locations; and determining a position-based distance estimation of the rail vehicle consist based at least in part on the location data, the position-based distance estimation representative of the separation of the rail vehicle consist from the one or more reference points;

wherein the location estimation of the rail vehicle consist is determined based at least in part on the speed-based distance estimation and the position-based distance estimation.

27. A system comprising:

a speed sensor for generating speed data that represents a velocity of a vehicle system along a route;

a position determination device for generating location data that represents a position of the vehicle system along the route; and one or more controllers for determining a speed-based distance of the vehicle system from a reference location based on the speed data and for determining a location-based distance of the vehicle system from the reference location based on the location data, the one or more controllers also for determining a location estimation of the vehicle system along the route based on the speed-based distance and the location-based distance and for determining a quality value of the location estimation based on the location data, wherein the one or more controllers also are for at least one of autonomously controlling or directing manual control of the velocity of the vehicle system according to a trip plan that designates speeds of the vehicle system as a function of distance along the route, the one or more controllers for using the location estimation to determine the velocity of the vehicle system according to the trip plan responsive to the quality value remaining within a designated range, wherein the vehicle system is a rail vehicle consist having a locomotive, and the speed sensor, the position determination device, and the one or more controllers are disposed onboard the locomotive.

28. The system of claim 27, wherein the one or more controllers are configured to cease the at least one of autonomously controlling or directing manual control of the velocity of the vehicle system according to the trip plan responsive to the quality value being outside of the designated range.

29. The system of claim 27, wherein the one or more controllers are configured to continue the at least one of autonomously controlling or directing manual control of the velocity of the vehicle system according to the trip plan even when the quality value is outside of the designated range if the velocity of the vehicle system is less than a designated speed limit of the route by at least a designated amount.

30. The system of claim 27, wherein the one or more controllers also are for presenting a map to an operator of the vehicle system to notify the operator of where the vehicle system is located along the route, the one or more controllers configured to stop presenting the map to the operator responsive to the quality value being outside of the designated range.

31. The system of claim 27, wherein the speed sensor is configured to provide a speed uncertainty signal that is representative of uncertainty in an accuracy of the speed data, and the one or more controllers are configured to determine the quality value based on the speed uncertainty signal.

32. The system of claim 27, wherein the position determination device is configured to provide a position uncertainty signal that is representative of uncertainty in an accuracy of the location data, and the one or more controllers are configured to determine the quality value based on the position uncertainty signal.

* * * * *